United States Patent [19]

DeSantis et al.

[11] 4,185,289

[45] Jan. 22, 1980

[54] SPHERICAL ANTENNAS HAVING ISOTROPIC RADIATION PATTERNS

[75] Inventors: Charles M. DeSantis, Neptune; Felix Schwering, Eatontown, both of N.J.

[73] Assignee: The United States of America as represented by the Secretary of the Army, Washington, D.C.

[21] Appl. No.: 941,878

[22] Filed: Sep. 13, 1978

[51] Int. Cl.[2] ..... H01Q 13/10

[52] U.S. Cl. ..... 343/770; 343/769; 343/767; 343/898

[58] Field of Search ..... 343/767-771, 343/898, 705, 708

[56] References Cited

U.S. PATENT DOCUMENTS

| | | | |
|---|---|---|---|
| 3,100,892 | 8/1963 | Cutler | 343/769 |
| 4,032,917 | 6/1977 | Chin et al. | 343/771 |

OTHER PUBLICATIONS

Stratton, J. A., Electromagnetic Theory, 1941, McGraw Hill, pp. 558-561.

Harrington, R. F., Time Harmonic Electromagnetic Fields, 1961, McGraw Hill, pp. 298-303.

Weeks, W. L., Electromagnetic Theory for Engineering Applications, Wiley and Sons, pp. 541-549.

*Primary Examiner*—David K. Moore

*Attorney, Agent, or Firm*—Nathan Edelberg; Jeremiah G. Murray; Edward Goldberg

[57] ABSTRACT

Spherical antenna arrangements are disclosed utilizing annular slots in polar regions which are associated with resonant cavities having a $TE_{01}$ mode or a $TE_{11}$ mode of field distribution. This field distribution within the cavity produces a cosine field distribution around the annular slot which serves via proper cavity excitation to produce nearly hemispherical isotropic radiation characteristics. The resonant cavities may take on the form of a parallel-plate structure or a coaxial cylindrical structure. Circular polarization and hemispherical coverage with uniform gain is characteristic of the antenna when the cavities contain probes placed ninety degrees apart in azimuth at the same radius from center and coupled to the quadrature phase related ports of a signal coupler.

14 Claims, 8 Drawing Figures

SPHERICAL ANTENNAS HAVING ISOTROPIC RADIATION PATTERNS

The invention described herein may be manufactured and used by or for the Government for governmental purposes without the payment of any royalties thereon or therefor.

BACKGROUND OF THE INVENTION

This invention relates generally to antennas capable of uniform signal radiation or reception throughout a hemispherically shaped space. More particularly, the invention relates to spherical antennas employing radial cavities and/or cylindrical cavities.

The use of antenna assemblies for both transmission and reception of radio signals is well known, and such antenna assemblies have taken many diverse dimensions and/or shapes to accomplish specific objectives. Among such antennas known in the art are those used in satellite vehicles launched in orbit around the earth to serve as active radio relay stations. Commonly, the satellite vehicles are spherically shaped and employ a radiant cavity or structures in the proximity of the diameter of the sphere. The satellite is then spin stabilized about an axis normal to the orbit so that the antenna is essentially equatorially positioned in the vehicle. Typically, the radiation pattern of these conventional antennas is rather directional and strongest in the plane of the active antenna element.

Antennas that are located near the surface of the earth which communicate with satellite vehicles have also taken on many different forms each suited for a particular application. The specific characteristics of an anetnna in a specific application not only dictate requisite electromagnetic radiation characteristics but also desirable physical properties. Isotropic antenna radiation coverage, that is a pattern of constant relative power or sensitivity in a defined space, minimizes the effect of antenna orientation upon communication. Small physical size, high structural strength, and low wind resistance are desirable properties for such an antenna which would not limit its adaptability to almost any mobile application.

A primary object of this invention is to provide an antenna having an essentially hemispherical signal radiation characteristic of substantially uniform signal gain.

A further object is to provide an antenna of sufficient compactness and rigidity compatible with mobile uses including a utility range from manpack to airborne applications.

Another object is to provide an antenna having a circular polarization characteristic over a wide angular range.

A still further object is to provide an antenna whose size is small and whose weight is low.

A still further object is to provide an antenna in accordance with the aforementioned objectives also capable of rather broadband radiation characteristics in two distinct frequency ranges.

SUMMARY OF THE INVENTION

The present invention amply satisfies the foregoing characteristics by providing an antenna which has an improved isotropic circularly-polarized radiation pattern and which is both relatively simple and economical to make. In addition the antenna structure is adaptable in different respects and particularly suitable for both airborne, vehicles and ground applications.

The inventive principles utilize a resonant cavity within a spherical body located a distance from the center of the sphere. The cavity communicates with the sphere through an annular slot located on a polar region on its surface. The cavity is designed to support an electromagnetic field in the $TE_{01}$ mode which interacts with coupling elements which are in quadrature both in space with respect to the center of the cavity and in phase. With proper physical and electrical design, the radiation or signal reception characteristic of an antenna utilizing these principles is isotropic and circularly polarized over nearly a hemispherical space extending outward from the center of the sphere on the end where the annular slot is located.

In some of the further aspects of the invention, two different types of resonant cavities are utilized to feed the annular slot. One resonant cavity is a parallel-plate structure loaded with dielectric material. The other reasonant cavity utilizes coaxial cylinders wherein the space between them is loaded with dielectric material. Since the size of the spherical body is not critical in providing the isotropic radiation characteristic, one spherical body will accomodate more than one radiant cavity and annular slot. In one embodiment of the invention, two annular slots each with a resonant cavity are able to provide similar radiation characteristics at distinct frequencies.

BRIEF DESCRIPTION OF THE DRAWINGS

Other object, advantages, and novel features of the present invention will become apparent from the following detailed description when considered in conjunction with the accompanying drawings.

DETAILED DESCRIPTION

Figure 1:
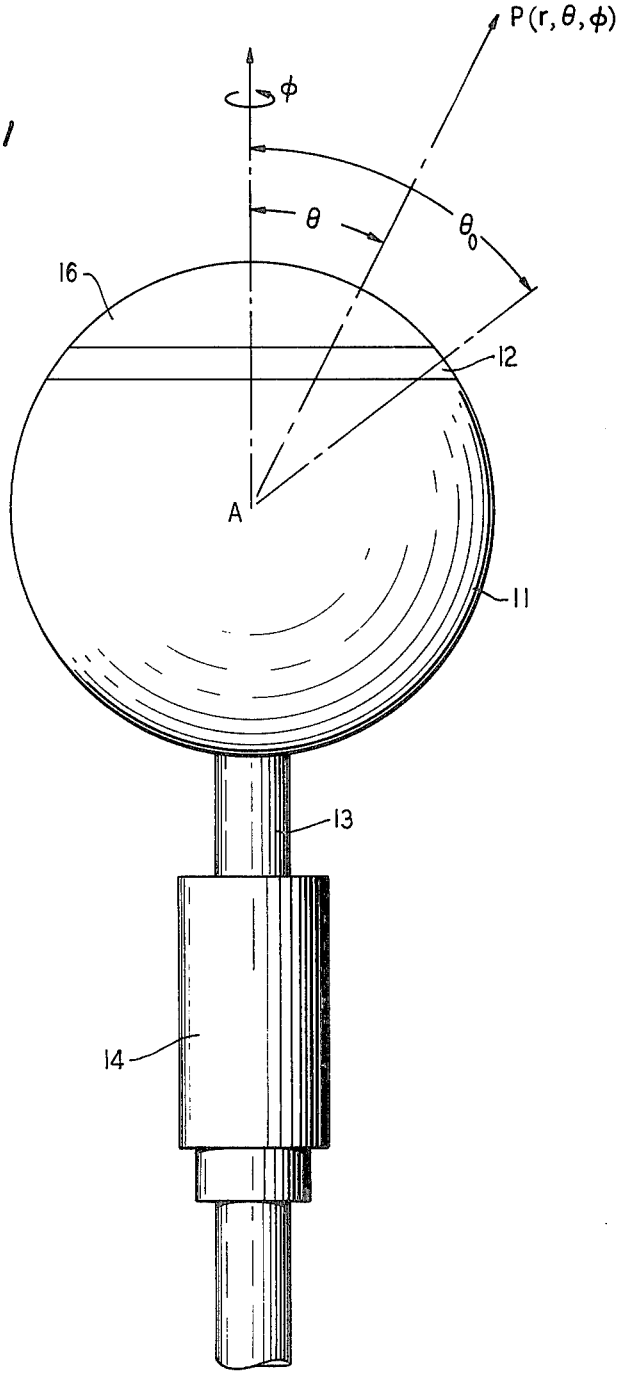
FIG. 1 is an elevation of an antenna in accordance with the invention.

FIG. 1 is an overall elevation illustration of an antenna embodying the inventive principles. The general form of the antenna is spherical as shown by body member 11. Typically, body member 11 may conveniently comprise two substantially hemispherical sections (not shown) which fit together to form the spherical structure below annular slot 12. Member 11 may be fabricated from a number of suitable materials but in any case must include an outer conductive layer. Member 11 also serves as a strength member that is supported by tube 13 which passes through choke sleeve assembly 14. Choke 14, which is well known in the art, is designed to provide the physical coupling that supports the antenna of FIG. 1 and at the same time provide electrical isolation between the antenna and the supporting structure.

Electromagnetic wave energy communicates with member 11 through annular slot 12. It should be noted that annular slot 12 is rather well displaced from the center of member 11 indicated by point A. Also present in FIG. 1 is a vertical axis which extends from point A out through the center of annular slot 12. Annular slot 12 is the portion of a parallel-plate resonant cavity which appears at the surface of member 11.

Figure 2:
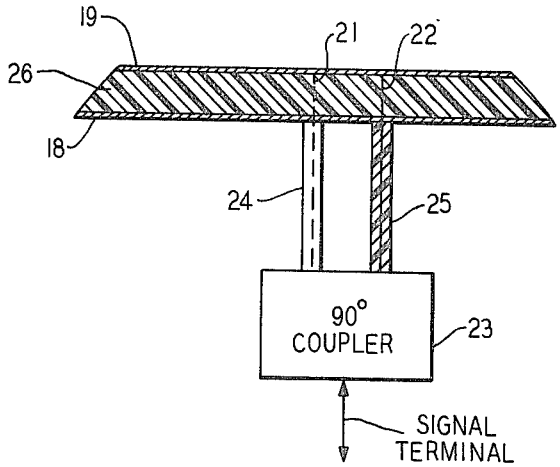
FIGS. 2 and 3 are orthogonal views of a resonant cavity for the antenna of FIG. 1.
Figure 3:
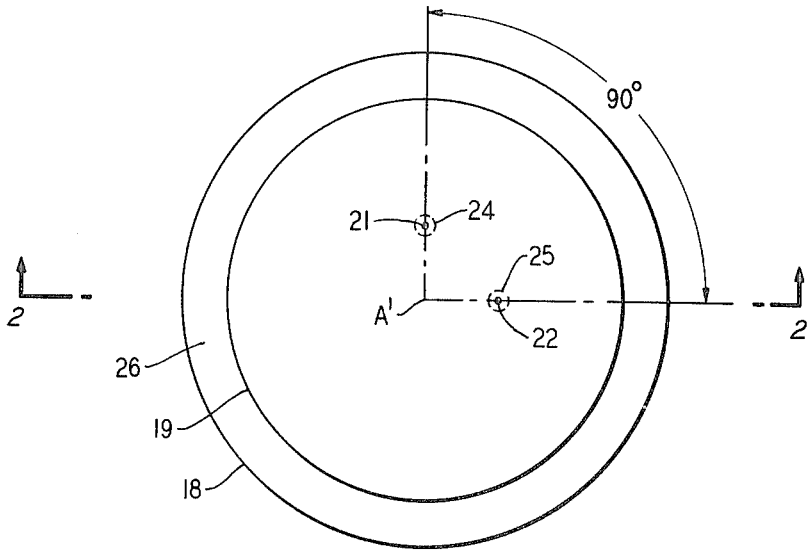

FIGS. 2 and 3 provide a side and a top view respectively of the parallel-plate resonant cavity. In the particular application for which the antenna of FIG. 1 was designed, it was necessary for the hemispherically isotropic radiant electromagnetic characteristic to also be circular polarized so that in addition to parallel plates 18 and 19 fed by probe 21, a second probe 22 and coupler 23 are included to provide the circular polarization characteristics. Coupler 23 is a suitable hybrid device which provides both an equal power split and a quadrature phase (ninety degrees) shift for operation via coaxial lines 24 and 25. The required phase shift may also be achieved at individual frequencies by making one of coaxial lines 24 and 25, feeding the cavity, longer by one-quarter of a wavelength than the other; and adjusting the input impedance of the cavity and the characteristic impedances of feedlines 24 and 25 to yield a desired input impedance when combined. FIG. 3 also illustrates that probes 21 and 22 are angularly displaced with respect to A' (the center of disc plates 18 and 19) by ninety degrees. As should be evident from FIG. 2 and 3, the cavity formed between plates 18 and 19 is loaded with dielectric material 26 and is resonant at the operating frequency.

Probes 21 and 22 during transmission provide a driving system for the resonant cavity to support a $TE_{01}$ mode field distribution. The approximate resonant frequency of the cavity is $$f = \frac{1.84C}{2\pi R\sqrt{\epsilon_r}}$$

where

C=velocity of light in vacuum

R=radius of the cavity $\epsilon_r$=dielectric constant of material 26

The electric field distribution around the circumference of the slot between plates 18 and 19 is a cosine field distribution for each of probes 21 and 22. The two fields are shifted ninety degrees both in space and time with respect to one another. The distance of the probes from the center of the cavity determines their load impedance. At the center of the cavity, the load impedance is zero and increases to about 400 ohms when fed right across the slot opening. Accordingly, probes 21 and 22 may be conveniently located to provide a standard load impedance of fifty ohms which occurs at a point approximately 0.37 of the radius (R) out from point A' when the dielectric material has an $\epsilon_r=10$. Typically, the value of $\epsilon_r$ may range from about 4 through to about 10. The spacing between plates 18 and 19 affects the instantaneous bandwidth of the cavity. The larger the spacing, the greater the bandwidth. However, the spacing may not be made arbitrarily large without detrimentally affecting the radiation efficiency and resonance characteristics of the cavity. The design considerations of these types of cavities is well known to those skilled in the art.

The boundary considerations for the overall antenna configuration of FIG. 1 will now be described with reference to the designated spherical coordinates. With the radius of the sphere again as R, the feedgap location or annular slot is $\theta_0$ and the observation point P is located by the coordinates (r, $\theta$, $\phi$)

For $r = R$, $E_\phi = 0$ and $$E_\theta = \begin{cases} 0 & \text{for } 0 \leqq \theta \leqq \theta_o - \Delta\theta \\ \dfrac{V e^{j\phi}}{2R\Delta\theta} & \text{for } \theta_o - \Delta\theta \leqq \theta \leqq \theta_o + \Delta\theta \\ 0 & \text{for } \theta_o + \Delta 0 \leqq \theta \leqq 180^\circ. \end{cases}$$

The field expressions in the far zone, r>>R, are:

$$E_\theta = \frac{V}{R}\,\frac{e^{-jx}}{x}\,e^{j\theta}\sin\theta_o \sum_{n=1}^{\infty} \frac{n+\frac{1}{2}}{n^2(n+1)^2}(j)^n \left[\frac{P_n^{1'}(\cos\theta)\,P_n^{1'}(\cos\theta_o)\sin\theta\sin\theta_o}{h'_{n+\frac{1}{2}}(x_o) + \dfrac{h_{n+\frac{1}{2}}(x_o)}{x_o}} + j\frac{1}{h_{n+\frac{1}{2}}(x_o)}\cdot\frac{P_n^1(\cos\theta)}{\sin\theta}\cdot\frac{P_n^1(\cos\theta_o)}{\sin\theta_o}\right]$$

$P_n^1$ is the associated Legendre polynomial of order 1 and degree n $P_n^{1'}$ is the derivative of the associated Legendre polynomial with respect to the argument.

$$E_\phi = -j\frac{V}{R}\,\frac{e^{-jx}}{x}\,e^{j\phi}\sin\theta_o \sum_{n=1}^{\infty} \frac{n+\frac{1}{2}}{n^2(n+1)^2}(j)^n \left[\frac{P_n^{1'}(\cos\theta_o)\sin\theta_o}{h'_{n+\frac{1}{2}}(x_o) + \dfrac{h_{n+\frac{1}{2}}(x_o)}{x_o}}\cdot\frac{P_n^1(\cos\theta_\phi)}{\sin\theta} + j\frac{P_n^{1'}(\cos\theta)\sin\theta}{h_{n+\frac{1}{2}}(x_o)}\;\frac{P_n^1(\cos\theta_o)}{\sin\theta_o}\right]$$

where $x = kr$, $x_o = kR$ and $h_{n+\frac{1}{2}}(u) = \sqrt{\dfrac{\pi}{2u}}\;H^{(2)}_{n+\frac{1}{2}}(u)$ are the spherical Hankel functions. Typical values of $\theta_0$ were 22.5, 30, 45 and 60 degrees and $k=2\pi/\lambda$ with $\lambda$ as the wavelength of the operating frequency.

For isotropic hemispherical pattern coverage and circular polarization, the optimum sphere size fell in the range of $1.25 \leqq kR \leqq 1.35$. This indicates that the size of the resonant cavity is the only portion of the antenna in which physical dimensions require accurate control. From another standpoint, an advantage of this antenna configuration is that the major physical portion of the structure need not be made to close tolerances thereby reducing the overall cost of fabrication. However, a high degree of symmetry is important for the sphere to provide an optimum isotropic characteristic. Accordingly, the spherical body may be readily adapted to have affixed thereto the resonant cavity constructed of parallel plates which are much easier to make precisely.

Figure 4:
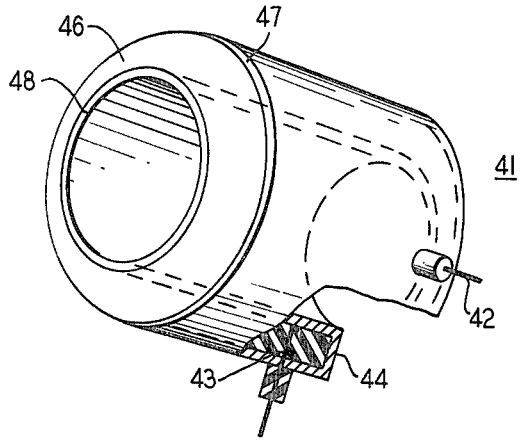
FIG. 4 is a perspective view of another type of resonant cavity suitable for the antenna of FIG. 1.

FIG. 4 depicts an alternative feed arrangement for the annular slot. A higher order mode coaxial line is depicted by coaxial feed 41. Coaxial feed 41 includes coupling probes 42 and 43 which are connected to hybrid coupler in the same manner as probes 21 and 22 of FIGS. 2 and 3. Probes 42 and 43 are also circumferentially displaced about the center line of coax 41 by ninety degrees. End 44 of coax 41 is short circuited and is located approximately one-quarter of a wavelength from probes 42 and 43. Annular slot 46 is coupled directly to the slot in member 11 of FIG. 1 instead of the resonant cavity shown in FIG. 3. It should be noted that the two methods of feeding the resonant slot are considered to be electrically equivalent. The cutoff frequency of the coaxial resonator is determined by finding the $p^{th}$ root of the characteristic equation for the system.

$$J_n'(k_p a)\, N_n'(k_p b) - N_n'(k_p a)\, J_n'(k_p b) = 0$$

where $J_n'$ and $N_n'$ are Derivatives of the Bessel & Neuman functions of order n; a is the outer radius of inner cylinder 48; b is the inner radius of outer cylinder 49; and $k_p = 2\pi/\lambda p$; $\lambda p$ is the cutoff wavelength for mode designated by n and p. For use in the sphere, the $TE_{11}$ mode of the coaxial line is of interest, i.e. $n = p = 1$.

Figure 5:
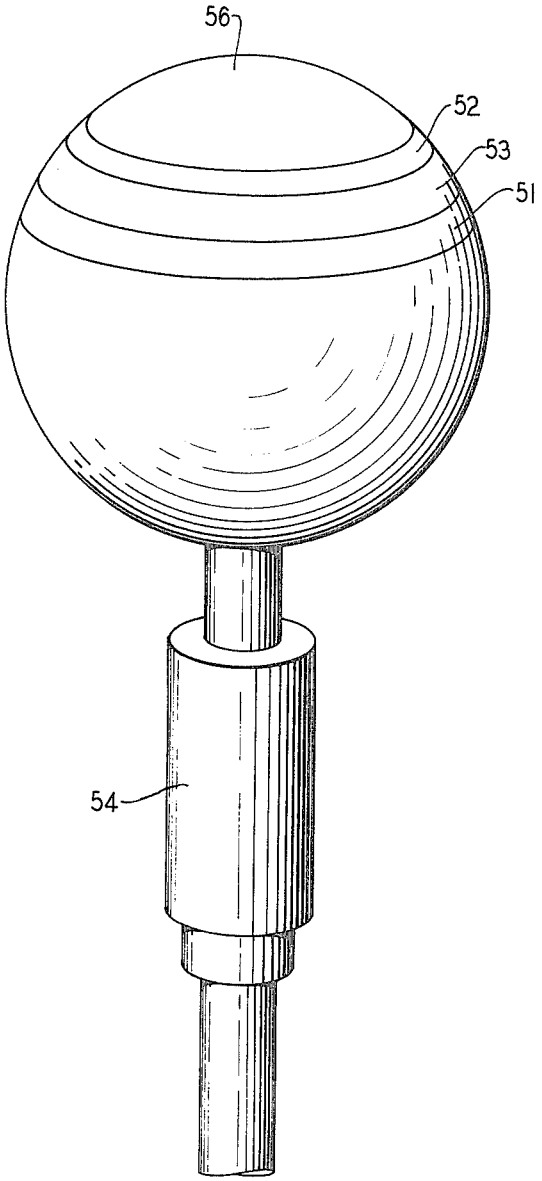
FIG. 5 is a perspective view of an antenna which includes two annular slots.

FIG. 5 is a perspective view of another overall spherical antenna utilizing two radiant slots. The overall construction of the antenna of FIG. 5 is essentially the same as that of FIG. 1 except for items which will be discussed. Slot 51 operates at a frequency lower than the frequency of operation of slot 52. Metallic band 53 provides the physical separation between slots 51 and 52. Due to the distance of slot 51 from the spheroidal equator of the antenna of FIG. 5, slot 52 is a greater distance from same and thus has a smaller radius and higher operating frequency in accordance with the resonance expression of slot structures. With the antenna designed for L- band (1.5 GHz) operation, the difference between the operating frequencies of slots 51 and 52 may conveniently be 350 MHz and yet provide similar radiation characteristics.

In addition to the foregoing considerations of the antenna of FIG. 5, each of slots 51 and 52 requires a resonant structure. A convenient arrangement of accomplishing this is to use the coaxial feed of FIG. 4 for slot 51. Then, through the hollow portion of sleeve 48 two separate coaxial cables are run to feed slot 52 as shown in FIGS. 2 and 3. On the other hand, a pair of radial cavities as shown in FIGS. 2 and 3 having coaxial cable feeds may be used for both slots by running the cables for the upper resonator, through the center of the cavity feeding the lower slot 51. A small central hole in the radial cavity may be provided without affecting the pertinent electrical characteristics of that cavity. Alternatively, two arrangements of FIG. 4 may be used in a coaxial format to feed each of the slots individually. In fact, by properly adjusting the electrical coupling between the two cavities one pair of feed cables may be eliminated, and both cavities may be fed from a single set of cables.

The antenna of FIG. 5 is able to provide similar radiation characteristics at the two operating frequencies of slots 51 and 52. The hollow cavity in the antenna below slot 51 may be utilized to house the two hybrid couplers for the two slots. Also, sleeve choke assembly 54 must now provide RF choke isolation at the two distinct operating frequencies. Another advantage common to the antennas of FIGS. 1 and 5 is that respective polar cap members 16 and 56 will not significantly affect performance by being omitted. In other words, the boundary conditions of the antenna are pretty well defined irrespective of the polar cap.

Figure 6:
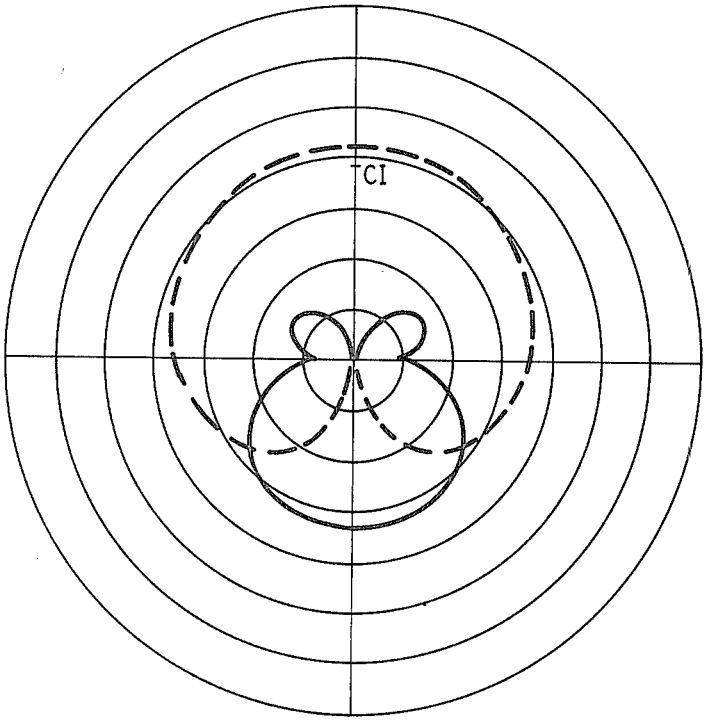
FIGS. 6, 7, and 8 depict various radiation patterns for different antenna parameters.

FIG. 6 depicts a theoretical radiation pattern in the elevation plane. In this case, the power is plotted for $kR = 1.35$ and slot location at $\theta_0 = 22.5$ degrees. The dashed line curve indicates right hand circular polarization and the solid line curve indicates left hand circular polarization. The zero dBIC point is marked as "CI" on the vertical axis which corresponds to the axis in FIG. 1. The increment between concentric circular lines is indicative of a 10dB change in power.

Figure 7:
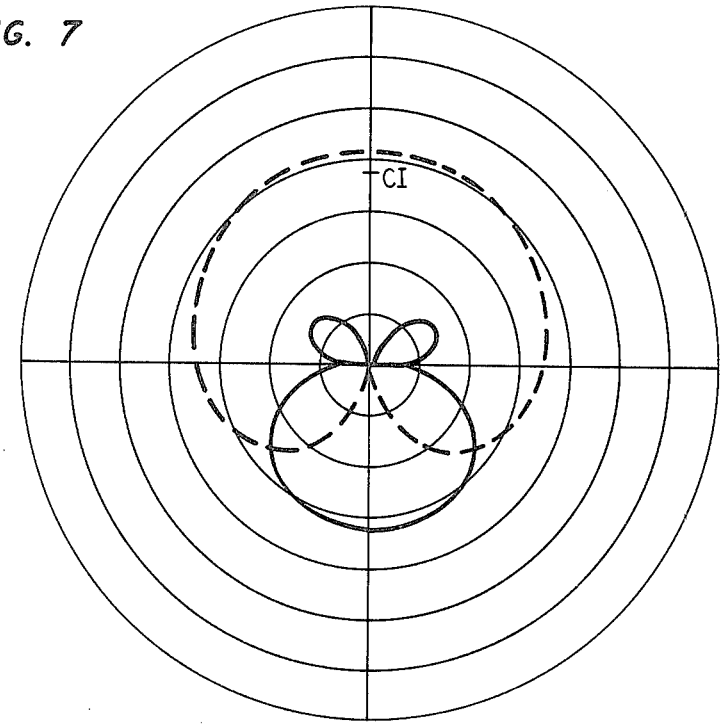
Figure 8:
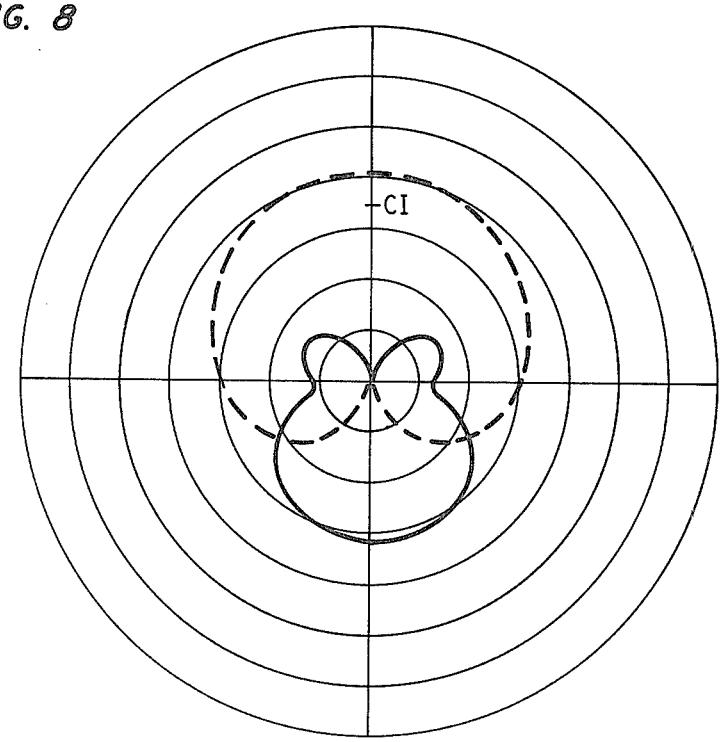

FIGS. 7 and 8 are similar radiation patterns in the elevation plane. FIG. 7 has values of $kR = 1.35$ and $\theta_0 = 30°$. Values of $kR = 1.35$ and $\theta_0 = 60$ provide the radiation pattern of FIG. 8. Experimental observations made with this antenna indicate that within the optimum kR range, the larger the sphere and the greater the distance of the annular slot or feedgap from the spheroidal center the better the radiation characteristics appear to be.

Obviously, many modifications and variations of the present invention are possible in light of the above teachings. It is therefor to be understood that within the scope of the appended claims, the invention may be practiced otherwise than as specifically described.

We claim:

1. An antenna comprising:

a substantially spherical body having a center and an outer conductive surface;

two spaced conductive members located in said body providing a resonant cavity therebetween and including an annular slot communicating with said outer surface, said spaced conductive members being displaced from the center of said body for locating said annular slot in a polar region on said body; and first and second probe means having respective conductors connected to one of saaid spaced conductive members for coupling between wave energy in said resonant cavity and signal energy, said probes being angularly displaced from each other by 90° about said center for coupling energy to said one spaced conductive member in a quadrature phase relation.

2. An antenna in accordance with claim 1 wherein said spaced conductive members are parallel disc plates displaced different distances from the center to provide the spacing between them.

3. An antenna in accordance with claim 1 wherein said spaced conductive members are cylindrical and have a common axis that is oriented to pass through said center, each of said members having a different diameter so that the difference of diameters provides the spacing between them.

4. An antenna in accordance with claim 2 wherein said first and second conductors extend through respective openings in the other of said spaced conductive members and are in electrical contact with said one spaced conductive member, and said first and second probes are capable of producing a $TE_{01}$ field distribution in said resonant cavity and a cosine field distribution around the circumference of said annular slot.

5. An antenna in accordance with claim 3 wherein said first and second conductors extend through respective openings in the other of said spaced conductive members and are in electrical contact with said one spaced conductive member, and said first and second probes are capable of producing a $TE_{11}$ field distribution in said resonant cavity and a cosine field distribution around the circumference of said annular slot.

6. An antenna in accordance with claim 4 wherein said second probe means field distribution are in quadrature to that of said first probe to provide a circular polarization field characteristic.

7. An antenna in accordance with claim 5 wherein said field distributions are in quadrature to that of said first probe to provide a circular polarization field characteristic.

8. An antenna in accordance with claim 6 further comprising a second set of two spaced conductive members located in said body providing a second resonant cavity therebetween and including a second annular slot communicating with said outer surface and having a different diameter than said first annular slot and a different resonant frequency than the first said resonant cavity.

9. An antenna in accordance with claim 7 further comprising a second resonant cavity and annular slot having a different circumference than said first annular slot, and another means for coupling between signal energy and wave energy in said second resonant cavity at a resonant frequency different than that of said first resonant cavity.

10. An antenna in accordance with claim 8 further comprising another means for coupling between wave energy in said second resonant cavity and signal energy.

11. An antenna according to claim 9 wherein said other means for coupling comprise a third probe capable of producing a $TE_{11}$ field distribution in said second resonant cavity and a cosine field distribution second the circumference of said other annular slot.

12. An antenna in accordance with claim 10 wherein said other means for coupling comprises a third probe capable of producing a $TE_{01}$ field distribution in said second resonant cavity and a cosine field distribution around the circumference of said second annular slot.

13. An antenna in accordance with claim 11 wherein said other means for coupling further comprises a fourth probe displaced from said third probe, and a hybrid coupler having a main terminal and two secondary terminals, one of said secondary terminals in circuit with said third probe, and the remaining one of said secondary terminals in circuit with said fourth probe.

14. An antenna in accordance with claim 12 wherein said other coupling means comprises a fourth probe and a hybrid coupler having a main terminal and two secondary terminals, and one of said secondary terminals coupled to said third probe while the other of said secondary terminals is coupled to said fourth probe.

* * * * *